US006564791B1

(12) United States Patent
Hammen

(10) Patent No.: US 6,564,791 B1
(45) Date of Patent: May 20, 2003

(54) QUIVER

(76) Inventor: Paul W. Hammen, W4754 County Rd. E., Bonduel, WI (US) 54107

( * ) Notice: Subject to any disclaimer, the term of this patent is extended or adjusted under 35 U.S.C. 154(b) by 0 days.

(21) Appl. No.: 10/034,755

(22) Filed: Dec. 28, 2001

(51) Int. Cl.[7] ..... F41B 5/06
(52) U.S. Cl. ..... 124/86; 124/25.5; 224/916
(58) Field of Search ..... 124/25.5, 25.7, 124/86; 224/916

(56) References Cited

U.S. PATENT DOCUMENTS

| | | | | |
|---|---|---|---|---|
| 2,984,277 A | | 5/1961 | Neff | |
| 3,088,583 A | | 5/1963 | Holtz | |
| 3,301,386 A | * | 1/1967 | Carter | |
| 3,337,028 A | | 8/1967 | Glavan | |
| 4,387,805 A | * | 6/1983 | Lanius | |
| 4,955,473 A | | 9/1990 | Van Hout et al. | |
| 5,215,070 A | * | 6/1993 | Brown | 124/86 |
| 5,258,166 A | | 11/1993 | Janzer et al. | |
| 5,358,108 A | | 10/1994 | Celaya | |
| 5,409,109 A | | 4/1995 | Smith | |
| 5,690,088 A | | 11/1997 | Ruble | |

* cited by examiner

*Primary Examiner*—John A. Ricci
(74) *Attorney, Agent, or Firm*—Wilhelm Law Service; Thomas D. Wilhelm

(57) ABSTRACT

A quiver has arrow-holding cells, holding arrows, each cell closed along a top wall, a bottom wall, and one or more longitudinal closure sidewalls, as well as having one or more open sides. The cells pivot with respect to each other, on hinges. The quivers have an enclosing configuration, and an open configuration, preferably a plurality of potential open configurations. In open configurations, closure side walls can have free edges adjacent each other, or closure side walls bearing free edges are adjacent each other, or open side walls provide access to arrows about substantially a full circle about the longitudinal axis of the quiver, or the quiver exposes more than 180 degrees of open wall, and/or arrow holders hold the arrows against unintended falling out at any orientation of the quiver.

20 Claims, 3 Drawing Sheets

FIG. 1A
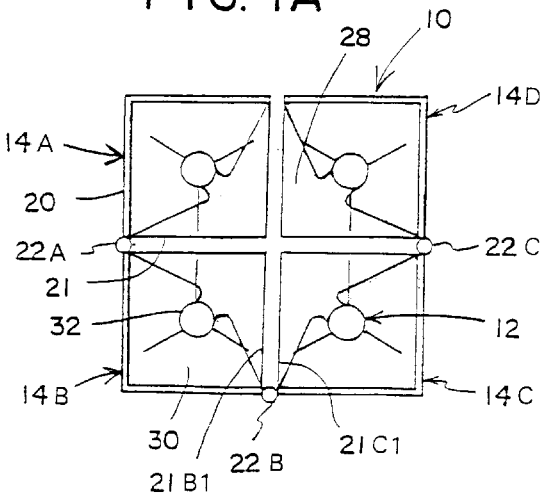
FIG. 2A
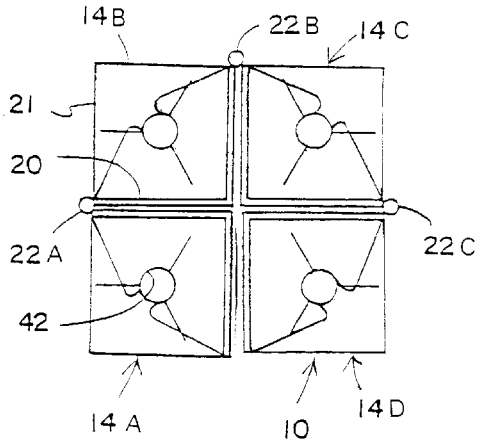
FIG. 3B
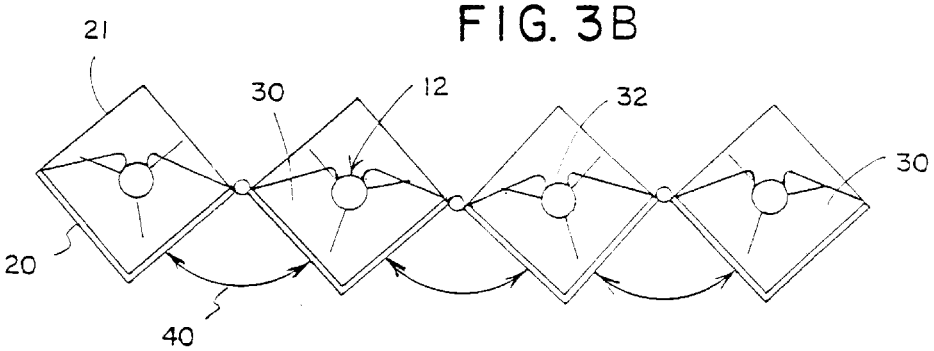
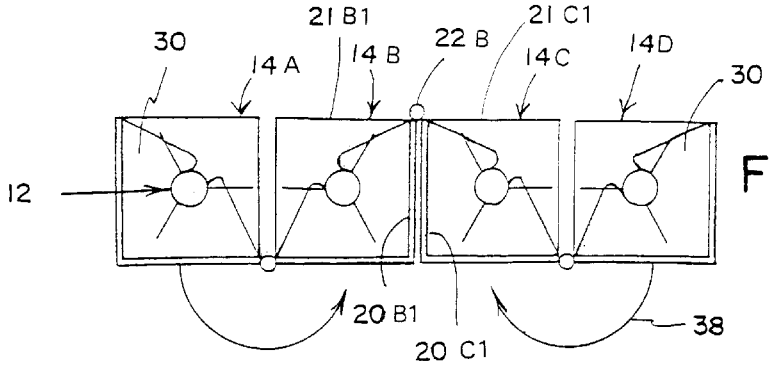
FIG. 3A

QUIVER

BACKGROUND

This invention relates to archery and archery hunting, and particularly to quivers which are used to store or transport arrows used in archery or archery hunting. It is well known in the sports of archery and hunting that the sportsman's goal is to shoot arrows in straight flight and to repeatedly hit the target accurately. In order to achieve this goal, an archer's arrows must be in the best possible condition.

Generally, arrows have a long, straight shaft, a pointed tip at one end, a notch at the opposite end, and fletchings adjacent the notch at the opposite end. During storage and transportation, if the arrows are allowed to shift so as to come in contact with each other or in contact with other objects, or if the arrows are allowed to become exposed to the elements of nature, damage to the arrows can occur. The shaft can become warped, bowed, or even cracked or broken. The tips can be dulled, and the fletchings, which are delicate and critical to the arrows' flight performance, can be damaged.

In addition to the above described major damages which can be visited on the elements of the arrow when not protected during e.g. ground transportation, any of the elements of the arrow can be scratched, dented, or otherwise experience visibly minor damage, but damage which changes the flight characteristics of the arrow enough to make a difference in satisfaction of the archer who uses such arrow. Since the archer is relying on known flight characteristics of the arrow, any deviation from such flight characteristics jeopardizes the achievement of hitting the intended target at the intended location.

Thus, it is known that it is desirable to protect arrows from incidental environmental damage to the arrows before such time as the arrows are used for shooting purposes. It is known, for example, to protect the arrows from such incidental damage by securing the arrows in a spaced apart relationship at both the point end and the notch end.

It is also known to provide quivers which totally enclose the arrows, thereby protecting the arrows from the elements of nature. However, such known quivers provide only limited access to the arrows.

There is thus a need for a quiver which can protect the arrows from incidental damage prior to the arrows being used for shooting, which can optionally shield the arrows from the ambient environment, and yet which provides easy access to the arrows in close quarters.

It is an object of the invention to provide a quiver which has a plurality of arrow-holding cells wherein the cells can pivot from a closed configuration wherein the quiver encloses and protects the arrows to an open configuration wherein enclosing side walls of the cells are disposed in facing relationships with each other.

It is another object of the invention to provide a quiver which has a plurality of arrow-holding cells wherein the cells can pivot from a closed configuration wherein the quiver encloses and protects the arrows to an open configuration wherein free edges of the cells are disposed closely adjacent each other.

It is still another object of the invention to provide a quiver which has a plurality of arrow-holding cells wherein the cells can pivot from a closed configuration wherein the quiver encloses and protects the arrows to an open configuration wherein the open walls provide access to the arrows about substantially a full circle defined about a longitudinal axis of the quiver, and whereby a user can retrieve an arrow from the quiver from virtually any angle perpendicular to the longitudinal axis.

Yet another object of the invention is to provide a quiver which has a plurality of arrow-holding cells wherein, from a closed configuration wherein the quiver encloses and protects the arrows, the quiver can pivot at least one of the cells about at least one of the hinges to collectively expose the open walls of cells of the quiver collectively about greater than 180 degrees of a circumference of an open configuration of the quiver, and wherein the arrow holders hold the arrows in the quiver against unintended falling out, at any orientation of the quiver while the open walls collectively define greater than 180 degrees of such circumference.

SUMMARY

The present invention is a quiver which protects arrows from damage caused by contact with each other, or contact with the elements of nature or the surrounding environment, during storage, transportation, or use, and which provides convenient accessibility to the arrows. The quiver is comprised of arrow-holding cells, each holding preferably one arrow, and each closed along a top wall, a bottom wall, and one or more longitudinal closure sides, as well as having one or more open side walls. The cells collectively define the quiver. The cells are mounted for pivotation with respect to each other, with longitudinally extending hinges. Quivers of the invention have an enclosing configuration, and an open configuration, preferably a plurality of potential open configurations. In some embodiments, closure side walls have free edges which are adjacent each other, or closure side walls bearing free edges are adjacent each other. In some embodiments, in open configuration, open walls provide access to arrows about substantially a full circle about the longitudinal axis of the quiver. In some embodiments, again in open configuration, the quiver exposes more than 180 degrees of open wall, and arrow holders hold the arrows against unintended falling out at any orientation of the quiver.

In a first family of embodiments, the invention comprehends a quiver for holding arrows. The quiver comprises a plurality of arrow-holding cells. Each cell comprises a top wall having a top wall perimeter, and a bottom wall having a bottom wall perimeter. Respective cells comprise (i) a cell perimeter generally extending along a length of the cell and between the top wall perimeter and the bottom wall perimeter, (ii) at least one longitudinally-extending enclosing side wall enclosing at least a first side of the cell perimeter, and comprising greater than 90 degrees about the perimeter of the respective cell, (iii) at least one open wall defining at least a second side of the cell perimeter comprising at least about 60 degrees about the perimeter of the respective cell, and (iv) arrow holder apparatus effective to hold an arrow against unintended transverse movement. The quiver further comprises hinges connecting the cells serially to each other such that the cells can pivot with respect to each other about the hinges. The side walls and hinges are configured and arranged with respect to each other such that the cells can collectively define an enclosing arrangement whereby the enclosing side walls and hinges define a generally closed container configuration enclosing the arrow holder apparatus therein, including unhinged longitudinal free edges of first and second ones of the cells in proximal relationship with respect to each other, and such that the cells can collectively pivot about the hinges thereby to bring respective ones of the enclosing side walls toward a central portion of the quiver, and to correspondingly face respective ones of the open walls outwardly from the central portion of the quiver, in a fully reversed and open container configuration of the quiver wherein (v) ones of the enclosing side walls bearing the free edges of the first and second cells are disposed in facing relationship with each other and/or (vi) the free edges are disposed closely adjacent each other.

In preferred embodiments, the cells can collectively pivot about the hinges thereby to bring respective ones of the enclosing side walls toward a central portion of the quiver and can correspondingly face respective ones of the open walls outwardly from the central portion of the quiver, in a fully reversed configuration, defined about a longitudinal axis of the reversed configuration quiver.

In preferred embodiments, the arrow holding cells collectively define a common arrow-holding cavity when the quiver is in the closed container configuration.

Also in preferred embodiments, the arrow holding cells define separate and distinct arrow-holding receptacles when the quiver is in the open-container configuration.

Still further to preferred embodiments, the quiver comprises biasing structure biasing the pivoting of the cells with respect to each other such that such pivoting comprises both stable and unstable relationships of the respective cells with respect to each other, and wherein the biasing structure automatically urges the cells to move toward the stable relationships and away from the unstable relationships.

In preferred embodiments, the open-container configuration and the closed configuration define a common set of outer length dimensions and transverse cross-section dimensions of the quiver.

Also with respect to preferred embodiments, the arrow holder apparatus is arranged, positioned, and configured so as to hold the arrow between the top wall and the bottom wall, and aligned with a longitudinal axis of the quiver, thus to limit longitudinal movement of such arrow.

In a second family of embodiments, the invention comprehends such plurality of arrow-holding cells, respective cells comprising the cell perimeter, the at least one longitudinally-extending enclosing side wall, the at least one open wall, the arrow holder apparatus, and the hinges, such that the cells can pivot with respect to each other, as well as the side walls and hinges being so configured, and arranged with respect to each other such that the cells can collectively define an enclosing arrangement whereby the enclosing side walls and hinges define a generally closed container configuration enclosing the arrow holder apparatus therein, and such that the cells can collectively pivot about the hinges thereby to bring respective ones of the enclosing side walls toward a central portion of the quiver, and to correspondingly face respective ones of the open walls outwardly from the central portion of the quiver, in a fully reversed and open container configuration of the quiver, defined about a longitudinal axis of the reversed configuration quiver, and wherein, in such fully reversed and open-container configuration, the open walls provide access to such arrows held in the arrow holder apparatus, about substantially a full circle defined about the longitudinal axis, whereby a user can retrieve an arrow from the quiver from virtually any angle perpendicular to the longitudinal axis.

In a third family of embodiments, the invention comprehends such plurality of arrow-holding cells, respective cells comprising the cell perimeter, the at least one longitudinally-extending enclosing side wall, the at least one open wall, the arrow holder apparatus, and the hinges, such that the cells can pivot with respect to each other, as well as the side walls and hinges being so configured, and arranged with respect to each other such that the cells can collectively define an enclosing arrangement whereby the enclosing side walls and hinges define a generally closed container configuration enclosing the arrow holder apparatus therein, and such that the cells can collectively pivot about the hinges thereby to open the quiver about at least one of the hinges to collectively expose one or more of the open walls as a portion of a perimeter of the quiver, and wherein the arrow holders hold the arrows in the quiver against unintended falling out, at any orientation of the quiver while the open walls collectively define any portion of the perimeter of the quiver.

BRIEF DESCRIPTION OF THE DRAWINGS

FIG. 1A shows a cross-section of the closed configuration quiver of FIG. 1 taken at 1A—1A of FIG. 1.

FIG. 2A shows a cross-section of the open configuration quiver of FIG. 2 taken at 2A—2A of FIG. 2.

FIG. 3A shows a cross-section as in FIG. 1A after the quiver has been transformed to a straight line open configuration.

FIG. 3B shows a cross-section as in FIG. 1A while the quiver is in the process of being transformed from the closed configuration of FIG. 1A to an open configuration.

Figure 1:
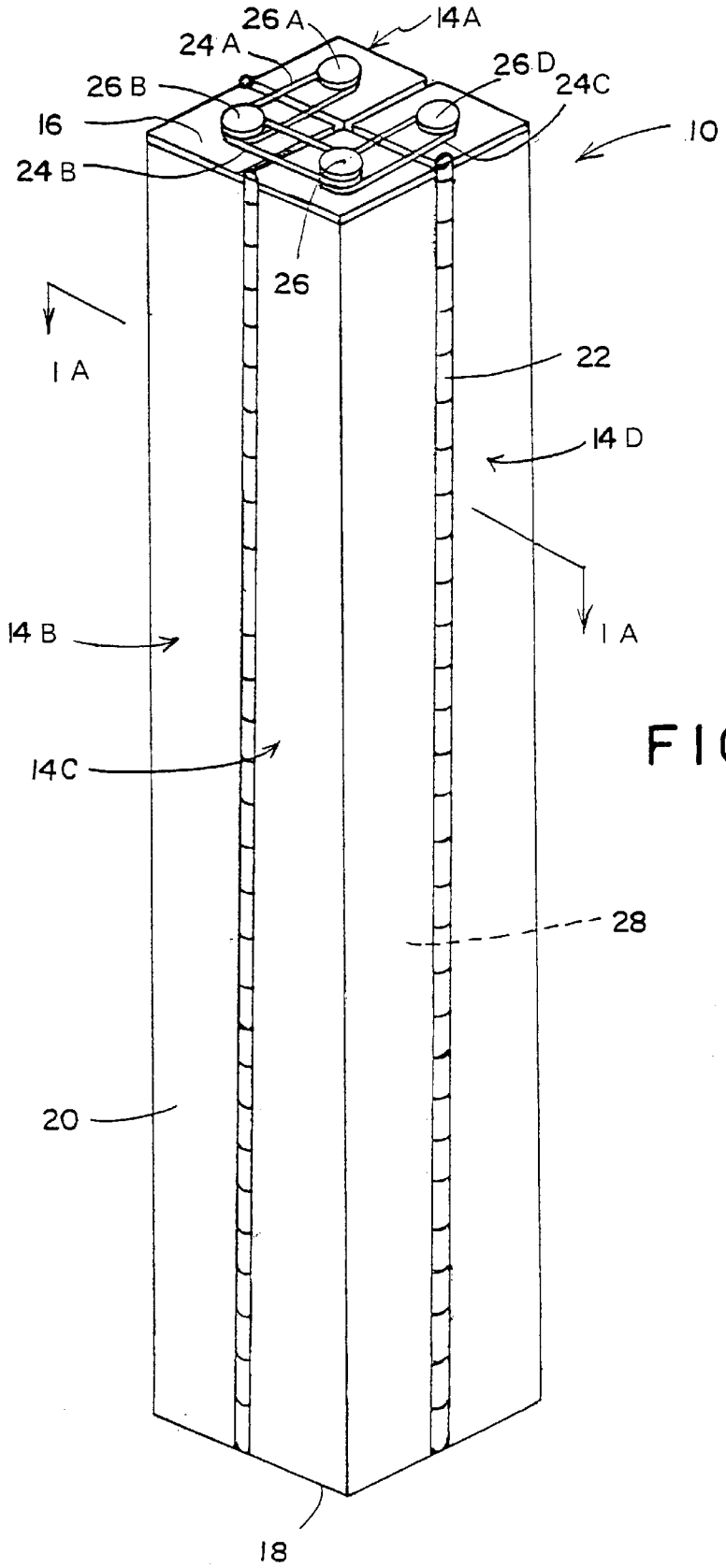
FIG. 1 shows a pictorial view of a quiver of the invention, in a closed configuration.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

Figure 2:
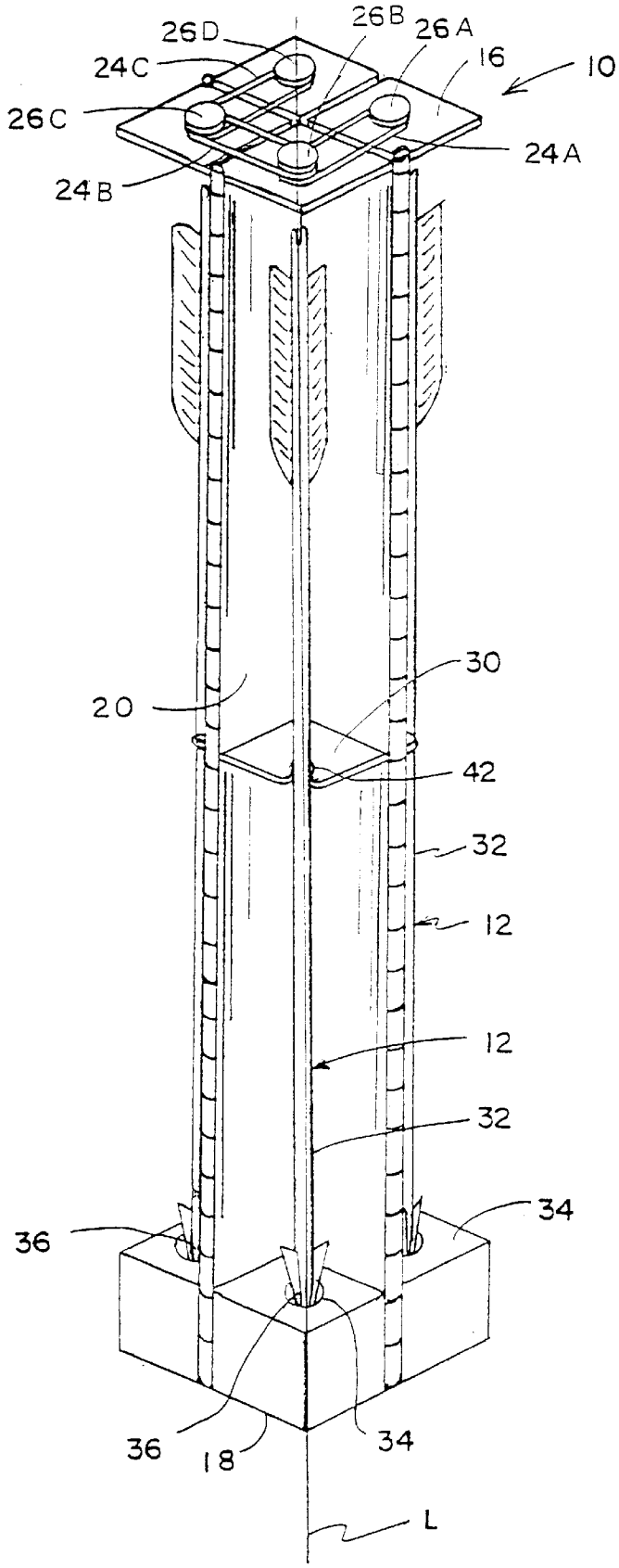
FIG. 2 shows a pictorial view of the quiver of FIG. 1 after the quiver has been transformed to the fully open, reversed configuration.

The drawings illustrate a quiver 10 of the invention which facilitates carrying arrows 12 in a closed and protected configuration, and which quiver structure facilitates quickly reconfiguring the quiver to an open configuration wherein the arrows are readily available for removal from the quiver and use in shooting such arrows with a bow. FIGS. 1 and 1A show the quiver in the closed configuration. FIGS. 2 and 2A show the quiver in the fully open and reversed configuration. FIG. 3A shows the quiver in the process of being converted between the open and closed configurations, in a stable configuration. FIG. 3B also shows the quiver in the process of being converted between the open and closed configurations, in an unstable configuration.

Referring to the drawings, quiver 10 includes a multiplicity of arrow-holding cells 14. Each cell has a top wall 16 defining a top wall perimeter, a bottom wall 18 defining a bottom wall perimeter, one or more longitudinal closure side walls 20 on respective longitudinal sides of the cell and one or more imaginary longitudinal open sides 21. A cell perimeter generally extends along the length of the cell between the top wall perimeter and the bottom wall perimeter. Closure side walls 20 of a given cell generally comprise at least 90 degrees of the perimeter of the cell, preferably 180 degrees of the perimeter of the cell, generally depending on the number of cells in the quiver. Open side walls 21 generally comprise at least 60 degrees of the perimeter of the cell, to provide suitable access to the arrows contained in the quiver.

The arrow holding cells 14 are assembled to each other with pivotation about hinges 22 at adjoining edges of the longitudinal closure side walls. Thus, cells 14A and 14B are connected to each other at hinge 22A. Cells 14B and 14C are connected to each other at hinge 22B. Cells 14C and 14D are connected to each other at hinge 22C.

Each cell which is connected to another adjacent cell by a hinge 22, at an edge of a closure side wall, is also connected to the respective adjacent cell by a biasing member such as a resiliently elastic band 24, the biasing member being mounted to the respective cell by a stud 26 at the top wall of the respective cell. Thus, resiliently elastic band 24A is mounted about studs 26A and 26B and connects cells 14A and 14B to each other with a biasing resilience. Band 24B is mounted about studs 26B and 26C and connects cells 14B and 14C to each other with biasing resilience. Band 24C is mounted about studs 26C and 26D and connects cells 14C and 14D to each other with biasing resilience.

Bands 24 are biased sufficiently to retain the bands on the studs, and to provide modest resilient resistence to articulation of the respective cells 14 about the respective hinges 22. Given the general mounting locations of the studs proximate the centers of the top walls, so long as the bands maintain biasing stress when the quiver is in the closed configuration shown in FIG. 1, the tendency of the bands is to maintain the cells in face-to-face relationship with each other such as in FIGS. 1 and 2, wherein the bands provide a biasing force which maintains the cells in proximal e.g. surface-to-surface abutting relationship with each other. Any movement of a cell to pivot about a hinge 22, away from a face-to-face relationship with respect to a hingedly adjoined cell is resisted by the biasing force on the respective band. Thus, as the cell pivots away from the configuration of FIG. 1, where the open side walls are facing each other with unhinged free edges of the closure walls 20 closely adjacent each other, about the hinge, the elongation of the respective band increases in relationship to such pivotation. If the initial pivotation force is released, the restoring force on the band automatically retracts the band and thus draws the cell back to the initial closed configuration wherein the cells are in face-to-face relationship with each other.

As the pivotation increases, the resistance to such pivotation increases until the rotation reaches about 90 degrees from the previously stable configuration. Upon passing the 90 degree mark, further pivotation reduces the distance between the respective studs 26 whereby the band force changes from resisting the movement to urging continuation of the pivotation until such time as the cell has pivoted 180 degrees, whereupon the cell has completed the maximum pivotation available. In such instance the pivoting cell is again in face-to-face relationship with the adjoining cell, but with ones of the closure side walls of such cells providing the face-to-face relationship.

In such fully reversed and open configuration, each cell defines a separate and distinct arrow-holding receptacle. Referring to FIGS. 1, 1A, 2, and 2A, the illustrated open container configuration and the illustrated closed container configuration, in the stable configurations, define a common set of outer length dimensions and transverse cross-section dimensions of the quiver.

Referring to FIG. 1A, cell 14B has a first open wall 21B1 in face-to-face relationship with open wall 21C1 of cell 14C. Referring to FIG. 3A, cell 14B has pivoted 180 degrees, from the configuration of FIG. 1A, about hinge 22B and has thereby separated open walls 21B1 and 21C1 from each other, and has brought closed wall 20B1 of cell 14B into face-to-face relationship with closed wall 20C1 of cell 14C. The result of a single such pivotation of a single cell 14B about a single hinge 22B results in the transformation of the quiver from the closed configuration of FIG. 1A to the straight line configuration of FIG. 3A. Such straight line configuration can as well be achieved by holding cells 14B and 14C stationary and pivoting cells 14A and 14D about cells 14B and 14C, respectively. Returning to the configuration shown in FIG. 3A, the complete full inversion of the quiver to the entirely open configuration is accomplished by subsequently pivoting cell 14A about cell 14B and by pivoting cell 14D about cell 14C, both as illustrated by indicator arrows 38, toward a central portion of the reconfiguring quiver, thereupon achieving the configuration illustrated in FIG. 2A. In the resulting configuration, all of the open walls 21 face outwardly from central longitudinal axis "L" of the fully open configuration quiver.

Overall, to transform the quiver from the configuration of FIGS. 1 and 1A to the configuration of FIGS. 2 and 2A, each of the hinges accomplishes a 180 degree pivotation. The order of pivotation is of no importance where full reversion is desired. Where a straight line configuration is desired, either hinges 22A and 22C will be pivoted, or only hinge 22B will be pivoted. It will be understood that any statement of pivotation of one cell with respect to the other equally states that the "other" cell is pivoting with the respect to the recited cell, whereby the pivotation can be expressed with respect to either cell acting with respect to the other.

In light of the structure and placement of studs 26 and bands 24, any position in which open or closed side walls of the cells are not facing each other represents an unstable position wherein the respective band is constantly urging the cell toward that face-to-face wall position which can be achieved with the least radial movement of the respective cells. FIG. 3B illustrates all four cells in unstable positions. In each case, the movement urged by bands 26 corresponds to no more than 90 degrees of movement. Indicator arrows 40 illustrate that the bands urge the side walls together in stable configurations. Studs 26 can be placed at loci other than the middles of the top walls whereby the change from resisting a movement direction to encouraging such movement direction is affected accordingly. Similarly, means other than resilient elastic bands can be used for biasing the pivoting action of the cells.

Quivers of the invention can be constructed without biasing bands 24. In such case, the user manually manipulates the cells to the desired configuration, and engages securing devices such as clips, hooks, or similar devices to hold the quiver in the desired open, closed, or other configuration.

A closed configuration of the assembled cells as in FIG. 1 provides a collective enclosure enclosing all of the respective arrow holders so as to define a common arrow-holding enclosing cavity 28. In addition to the top wall, the bottom wall, and the two closure side walls of each cell, each cell includes a shaft holder 30 which grasps and holds the shaft 32 of a respective arrow 12 held in the respective arrow holder. Each cell further includes a tip holder 34 which receives the tip 36 of a respective arrow 12 being held in the respective cell. Shaft holder 30 is positioned generally at least half the length of the shaft from the tip holder. Shaft holder 30 can be relatively thin, top to bottom, as illustrated in the drawings and can properly embrace and hold the shaft of the arrow, preferably by frictional engagement between the arrow holder 30 and the shaft of the arrow.

Tip holder 34 preferably has sufficient depth to receive such a length of the tip that longitudinal movement of the shaft of the arrow against the top wall of the cell does not release the tip end of the arrow from the tip holder. Rather, an arrow is released from the tip holder, and is thus released from the cell, only by transverse movement of the distal notch end of the arrow shaft toward one of open walls 21 of the cell whereby the notch end of the shaft of the arrow is released from under the top wall of the cell, whereupon the arrow can then be moved longitudinally in releasing the tip of the arrow from the tip holder. But so long as the tip of the arrow is disposed in tip holder 34 and the shaft is held in shaft holder 30, the arrow is retained in the cell.

Shaft holder 30 comprises a resilient e.g. plastic material having a notch 42 which resiliently receives and holds the shaft of the arrow. Accordingly, the arrow holders hold the shafts of the arrows against unintended falling out, at any orientation of the quiver while the open walls define any portion of the perimeter of the quiver.

Quiver 10 is preferably closed as shown in FIGS. 1 and 1A for transport of the quiver and arrows contained therein, such as through the woods. Referring especially to FIG. 1A, the closure side walls 20 of the respective cells form a generally enclosing structure defining a common enclosed quiver cavity wherein, other than the arrow holders and the tip holders, no obstruction, no internal structure of the quiver, is generally interposed between respective ones of the arrows. Rather, in such closed configuration, and as seen in FIG. 1A, the open sides 21 are turned inwardly toward each other such that the arrows are held in a common cavity collectively defined by the illustrated four cells.

As discussed above, the quiver can be converted to an open configuration as represented in FIGS. 2 and 2A to expose the arrows, such as for selection and use of the arrows. If desired, a single cell 14A or 14D can be pivoted 180 degrees about the respective hinge 22A or 22C thus to form a stable configuration (not shown) wherein arrows can be retrieved but wherein the quiver configuration is still somewhat closed.

If, however, a single cell 14B or 14C is pivoted about hinge 22B, the quiver is in general open in the straight-line configuration. However, the arrows are only available from a single general direction. Only when the cells are pivoted about all three hinges is the quiver converted to the fully open, fully reversed configuration shown in FIG. 2A. In such fully open, fully reversed, configuration, compared to the configuration of FIG. 1A, the arrows are available from any angle about a full circle defined about longitudinal axis "L" which extends the length of the quiver in the open configuration. Thus, a shooter can hang the open quiver on e.g. a peg or nail, from a carrying strap of the quiver (not shown) and at least one of the four arrows will at all times be facing the hunter for access thereto.

FIG. 1A shows a cross-section view of the closed quiver of FIG. 1, including illustrating arrows being held in the respective arrow holders. Especially FIG. 1 illustrates that the arrow-holding cavity is generally open and devoid of internal walls when the quiver is closed as illustrated in FIGS. 1 and 1A.

FIG. 3 illustrates generally a top cut-away view of the quiver, including arrows in the quiver, as the quiver is being converted from closed configuration (FIGS. 1A, 1B, 2A, 2B) to an open configuration, thereby to gain access to the contained arrows. FIG. 3 illustrates an unstable configuration of the quiver.

Closure side walls 20, top wall 16, and/or bottom wall 18, can in some embodiments include minor apertures or other openings therein e.g. for ingress and egress of ambient air. However, the closure side walls and top wall are typically free of such apertures in order to exclude ambient weather elements and the like from the quiver, thus to prevent e.g. water from getting on the arrows. Further reason for limiting the number and size of apertures in closure side walls 20 is to prevent unintended projection of twigs, branches, and the like into the quiver as a user thereof moves from place to place through the woods. Thus, in preferred embodiments, closure walls 20 and top wall 16 are generally imperforate, and provide a generally continuous outer wall which, in combination with bottom wall 18, provide a complete enclosure providing protection for the contained arrows. Where some opening is desired in the closed configuration of e.g. FIG. 1, suitable openings are typically made in bottom wall 18 which is the wall least susceptible of conveying precipitation or twigs, grasses, or branches into enclosure cavity 28.

Thus, the quiver of the invention provides a fully closed configuration as in FIGS. 1 and 1A, a partially open configuration wherein a single end cell has been pivoted, a straight line open configuration as in FIG. 3A, and a fully reversed 360 degree open configuration as in FIGS. 2 and 2A. When the quiver is displaced from any one of the above stable configurations, preferred biasing bands bias the quiver toward the closest stable configuration.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A quiver for holding arrows, said quiver comprising:

(a) a plurality of arrow-holding cells, each said cell comprising a top wall having a top wall perimeter, and a bottom wall having a bottom wall perimeter, respective said cells comprising (i) a cell perimeter generally extending along a length of the cell and between said top wall perimeter and said bottom wall perimeter, (ii) at least one longitudinally-extending enclosing side wall enclosing at least a first side of the cell perimeter, and comprising greater than 90 degrees about the perimeter of the respective cell, (iii) at least one open wall defining at least a second side of the cell perimeter comprising at least about 60 degrees about the perimeter of the respective cell, and (iv) arrow holder apparatus in said cell effective to hold an arrow against unintended transverse movement; and (b) hinges connecting the cells to each other such that said cells can pivot with respect to each other about said hinges, said side walls and said hinges being configured and arranged with respect to each other such that said cells can collectively define an enclosing arrangement whereby the enclosing side walls and hinges define a generally closed container configuration enclosing said arrow holder apparatus therein, including unhinged longitudinal free edges of first and second ones of said cells in proximal relationship with respect to each other, and such that said cells can collectively pivot about said hinges thereby to bring respective ones of said enclosing side walls toward a central portion of said quiver, and to correspondingly face respective ones of said open walls outwardly from the central portion of said quiver, in a fully reversed and open container configuration of said quiver wherein (v) ones of the enclosing side walls bearing the free edges of said first and second cells are disposed in facing relationship with each other and/or (vi) the free edges are disposed closely adjacent each other.

2. A quiver as in claim 1 wherein said cells can collectively pivot about said hinges thereby to bring respective ones of said enclosing side walls toward a central portion of said quiver and can correspondingly face respective ones of the open walls outwardly from the central portion of said quiver, in a fully reversed configuration, defined about a longitudinal axis of said reversed configuration quiver.

3. A quiver as in claim 1 wherein said arrow holding cells collectively define a common arrow-holding cavity when said quiver is in the closed container configuration.

4. A quiver as in claim 1 wherein said arrow holding cells define separate and distinct arrow-holding receptacles when said quiver is in the open-container configuration.

5. A quiver as in claim 1, further comprising biasing structure biasing the pivoting of the cells with respect to each other such that such pivoting comprises both stable and unstable relationships of the respective cells with respect to each other, and wherein said biasing structure automatically urges said cells to move toward the stable relationships and away from the unstable relationships.

6. A quiver as in claim 1 wherein the open-container configuration and the closed configuration define a common set of outer length dimensions and transverse cross-section dimensions of said quiver.

7. A quiver as in claim 1, said arrow holder apparatus being arranged, positioned, and configured so as to hold such arrow between said top wall and said bottom wall, and aligned with a longitudinal axis of said quiver, thus to limit longitudinal movement of such arrow.

8. A quiver for holding arrows, said quiver comprising:

(a) a plurality of arrow-holding cells, each said cell comprising a top wall having a top wall perimeter, and a bottom wall having a bottom wall perimeter, respective said cells comprising (i) a cell perimeter generally extending along a length of the cell and between said top wall perimeter and said bottom wall perimeter, (ii) at least one longitudinally-extending enclosing side wall enclosing at least a first side of the cell perimeter, (iii) at least one open wall defining at least a second side of the cell perimeter, and (iv) arrow holder apparatus in said cell effective to hold an arrow against unintended transverse movement; and (b) hinges connecting the cells to each other at the longitudinally extending enclosing side walls, such that said cells can pivot with respect to each other about said hinges, said side walls and said hinges being so configured, and arranged with respect to each other such that said cells can collectively define an enclosing arrangement whereby the enclosing side walls and hinges define a generally closed container configuration enclosing said arrow holder apparatus therein, and such that said cells can collectively pivot about said hinges thereby to bring respective ones of said enclosing side walls toward a central portion of said quiver, and to correspondingly face respective ones of said open walls outwardly from the central portion of said quiver, in a fully reversed and open container configuration of said quiver, defined about a longitudinal axis of said reversed configuration quiver, and wherein, in such fully reversed and open-container configuration, the open walls provide access to such arrows held in said arrow holder apparatus, about substantially a full circle defined about the longitudinal axis, whereby a user can retrieve an arrow from said quiver from virtually any angle perpendicular to the longitudinal axis.

9. A quiver as in claim 8 wherein said arrow holding cells collectively define a common arrow-holding cavity when said quiver is in the closed container configuration.

10. A quiver as in claim 8 wherein said arrow holding cells define separate and distinct arrow-holding cells when said quiver is in the open-container configuration.

11. A quiver as in claim 8, further comprising biasing structure biasing the pivoting of the cells with respect to each other such that such pivoting comprises both stable and unstable relationships of the respective cells with respect to each other, and wherein said biasing structure automatically urges said cells to move toward the stable relationships and away from the unstable relationships.

12. A quiver as in claim 8 wherein the open-container configuration and the closed configuration define a common set of outer length dimensions and transverse cross-section dimensions of said quiver.

13. A quiver as in claim 8, said arrow holder apparatus being arranged, positioned, and configured so as to hold such arrow between said top wall and said bottom wall, and aligned with the longitudinal axis of said quiver, thus to limit longitudinal movement of such arrow.

14. A quiver for holding arrows, said quiver comprising:

(a) a plurality of arrow-holding cells, each said cell comprising a top wall having a top wall perimeter, and a bottom wall having a bottom wall perimeter, respective said cells comprising (i) a cell perimeter generally extending along a length of the cell and between said top wall perimeter and said bottom wall perimeter, (ii) at least one longitudinally-extending enclosing side wall enclosing at least a first side of the cell perimeter;

(iii) at least one open wall defining at least a second side of the cell perimeter, and (iv) arrow holder apparatus in said cell effective to hold an arrow against unintended transverse movement; and (b) hinges connecting the cells to each other at the longitudinally extending enclosing side walls, such that said cells can pivot with respect to each other about said hinges, said side walls and said hinges being so configured, and arranged with respect to each other such that said cells can collectively define an enclosing arrangement whereby the enclosing side walls and hinges define a generally closed container configuration enclosing said arrow holder apparatus therein, and such that said cells can collectively pivot about said hinges thereby to open said quiver about at least one of said hinges to collectively expose one or more of the open walls as a portion of a perimeter of said quiver, and wherein said arrow holders hold said arrows in said quiver against unintended falling out, at any orientation of said quiver while the open walls collectively define any portion of the perimeter of said quiver.

15. A quiver as in claim 14 wherein said cells can collectively pivot about said hinges thereby to bring respective ones of said enclosing side walls toward a central portion of said quiver and can correspondingly face respective ones of the open walls outwardly from the central portion of said quiver, in a fully reversed said open configuration of said quiver, defined about a longitudinal axis of said reversed open configuration of said quiver.

16. A quiver as in claim 14 wherein said arrow holding cells collectively define a common arrow-holding cavity when said quiver is in the closed configuration.

17. A quiver as in claim 14 wherein said arrow holding cells define separate and distinct arrow-holding cells when said quiver is in the open-container configuration.

18. A quiver as in claim 14, further comprising biasing structure biasing the pivoting of the cells with respect to each other such that such pivoting comprises both stable and unstable relationships of the respective cells with respect to each other, and wherein said biasing structure automatically urges said cells to move toward the stable relationships and away from the unstable relationships.

19. A quiver as in claim 14 wherein the open-container configuration and the closed configuration define a common set of outer length dimensions and transverse cross-section dimensions of said quiver.

20. A quiver as in claim 14, said arrow holder apparatus being arranged, positioned, and configured so as to hold such arrow between said top wall and said bottom wall, and aligned with a longitudinal axis of said quiver, thus to limit longitudinal movement of such arrow.

* * * * *